US006308473B1

(12) United States Patent
Auck

(10) Patent No.: US 6,308,473 B1
(45) Date of Patent: Oct. 30, 2001

(54) ROOF LOUVER FILTER SYSTEM

(76) Inventor: Jamie Auck, 706 McKinley Ave., Underwood, ND (US) 58576

( * ) Notice: Subject to any disclaimer, the term of this patent is extended or adjusted under 35 U.S.C. 154(b) by 0 days.

(21) Appl. No.: 09/300,096

(22) Filed: Apr. 27, 1999

(51) Int. Cl.[7] ..... F24F 7/02

(52) U.S. Cl. ..... 52/199; 52/95; 52/101; 52/198; 52/309.1; 55/323; 55/385.1; 55/DIG. 36; 210/454; 454/67; 454/366

(58) Field of Search ..... 52/12, 57, 58, 52/60, 101, 200, 198, 199, 309.1, 309.4, 309.6, 404.1, 473, DIG. 15; 454/365, 366, 49, 67; 265/42, 43, 200, 201; 210/454; 55/488, 529, 323, 385.1, 385.2, DIG. 56

(56) References Cited

U.S. PATENT DOCUMENTS

| | | | | |
|---|---|---|---|---|
| D. 427,303 | * | 6/2000 | Brown | D23/387 |
| D. 428,484 | * | 7/2000 | Zirk | D23/393 |
| 4,949,514 | * | 8/1990 | Weler | 52/12 |
| 5,167,579 | * | 12/1992 | Rotter | 454/365 |
| 5,238,450 | * | 8/1993 | Rotter | 454/260 |
| 5,318,607 | * | 6/1994 | Malloy et al. | 55/323 |
| 5,339,582 | * | 8/1994 | Sells | 52/198 |
| 5,349,799 | * | 9/1994 | Schiedegger et al. | 52/473 |
| 5,425,672 | * | 6/1995 | Rotter | 454/365 |
| 5,596,852 | * | 1/1997 | Schiedegger | 52/212 |
| 5,651,734 | * | 7/1997 | Morris | 454/365 |
| 5,738,581 | * | 4/1998 | Rickert et al. | 454/365 |
| 5,775,032 | * | 7/1998 | Lacy | 52/28 |
| 5,782,051 | * | 7/1998 | LaVoie | 52/473 |
| 5,946,868 | * | 9/1999 | Morris | 52/199 |
| 5,947,817 | * | 9/1999 | Morris et al. | 454/365 |
| 5,974,748 | * | 11/1999 | Sciuga et al. | 52/287.1 |
| 6,015,343 | * | 1/2000 | Castillo et al. | 454/365 |
| 6,076,321 | * | 6/2000 | Holland | 52/473 |
| 6,149,701 | * | 11/2000 | Ellingson | 55/493 |

* cited by examiner

*Primary Examiner*—Yvonne M. Horton

(57) ABSTRACT

A roof louver filter system for preventing snow from entering an attic of a building structure through a roof louver vent during inclimate weather conditions. The inventive device is comprised of an air permeable material that is formed into a U-shaped structure for being positioned within a roof louver. The U-shaped structure includes a front portion, a first side portion and a second side portion. The first side portion includes a first slanted edge and the second side portion includes a second slanted edge for conforming to the rear rim of the roof louver when installed. The inventive device is preferably constructed of a polyester fiber material thereby preventing water and insects from entering into the roof louver. The inventive device prevents snow from directly blowing into the attic of the building through the roof louver during inclimate weather conditions.

4 Claims, 4 Drawing Sheets

ROOF LOUVER FILTER SYSTEM

BACKGROUND OF THE INVENTION

1. Field of the Invention

The present invention relates generally to roof louver vents and more specifically it relates to a roof louver filter system for preventing snow from entering an attic of a building structure through a roof louver vent during inclimate weather conditions.

2. Description of the Prior Art

Roof louver vents have been in use for years. Typically, a conventional roof louver is attached to the roof of the building structure. The roof louver typically has a tubular structure that extends through the roof of the building structure and extends from the exterior surface of the roof a finite distance thereby allowing moist air within the attic to escape the attic. A shield member is attached a finite distance above the tubular structure thereby allowing the escape of warm moist air while preventing the entry of precipitation such as snow, sleet or rain into the tubular structure. The shield member has an outer rim that extends downwardly in an attempt to prevent high winds from blowing precipitation into the tubular structure.

Unfortunately, during winter storms high swirling winds often times will force snow underneath the shield member of the roof louver into the tubular structure. The snow then either directly enters the attic or it is melted within the tubular structure and drains into the attic. The melted precipitation within the attic thereafter causes severe damage to the insulation and structure of the building. The water will also sometimes drain into the interior portion of the building causing water damage to the interior furnishings and sheet rock.

While these devices may be suitable for the particular purpose to which they address, they are not as suitable for preventing snow from entering an attic of a building structure through a roof louver vent during inclimate weather conditions. Conventional roof louvers allow rain and snow to enter the attic thereby allowing severe water damage to the building structure to occur.

In these respects, the roof louver filter system according to the present invention substantially departs from the conventional concepts and designs of the prior art, and in so doing provides an apparatus primarily developed for the purpose of preventing snow from entering an attic of a building structure through a roof louver vent during inclimate weather conditions.

SUMMARY OF THE INVENTION

In view of the foregoing disadvantages inherent in the known types of roof louver vents now present in the prior art, the present invention provides a new roof louver filter system construction wherein the same can be utilized for preventing snow from entering an attic of a building structure through a roof louver vent during inclement weather conditions.

The general purpose of the present invention, which will be described subsequently in greater detail, is to provide a new roof louver filter system that has many of the advantages of the roof louver vents mentioned heretofore and many novel features that result in a new roof louver filter system which is not anticipated, rendered obvious, suggested, or even implied by any of the prior art roof louver vents, either alone or in any combination thereof.

To attain this, the present invention generally comprises an air permeable material that is formed into a U-shaped structure for being positioned within a roof louver. The U-shaped structure includes a front portion, a first side portion and a second side portion. The first side portion includes a first slanted edge and the second side portion includes a second slanted edge for conforming to the rear rim of the roof louver when installed. The inventive device is preferably constructed of a polyester fiber material thereby preventing water and insects from entering into the roof louver. The inventive device prevents snow from directly blowing into the attic of the building through the roof louver during inclimate weather conditions.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a roof louver filter system that will overcome the shortcomings of the prior art devices.

Another object is to provide a roof louver filter system that prevents precipitation from entering an attic through a conventional roof louver.

An additional object is to provide a roof louver filter system that can be added to an existing roof louver.

A further object is to provide a roof louver filter system that does not interfere with the natural air flow through the roof louver.

Another object is to provide a roof louver filter system that does not interfere with the exterior appearance of the roof louver and building structure.

A further object is to provide a roof louver filter system that easily installs upon conventional roof louvers.

An additional object is to provide a roof louver filter system that reduces water damage to a building structure.

A further object is to provide a roof louver filter system that maintains the R value of the insulation by not allowing moisture to enter the attic.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
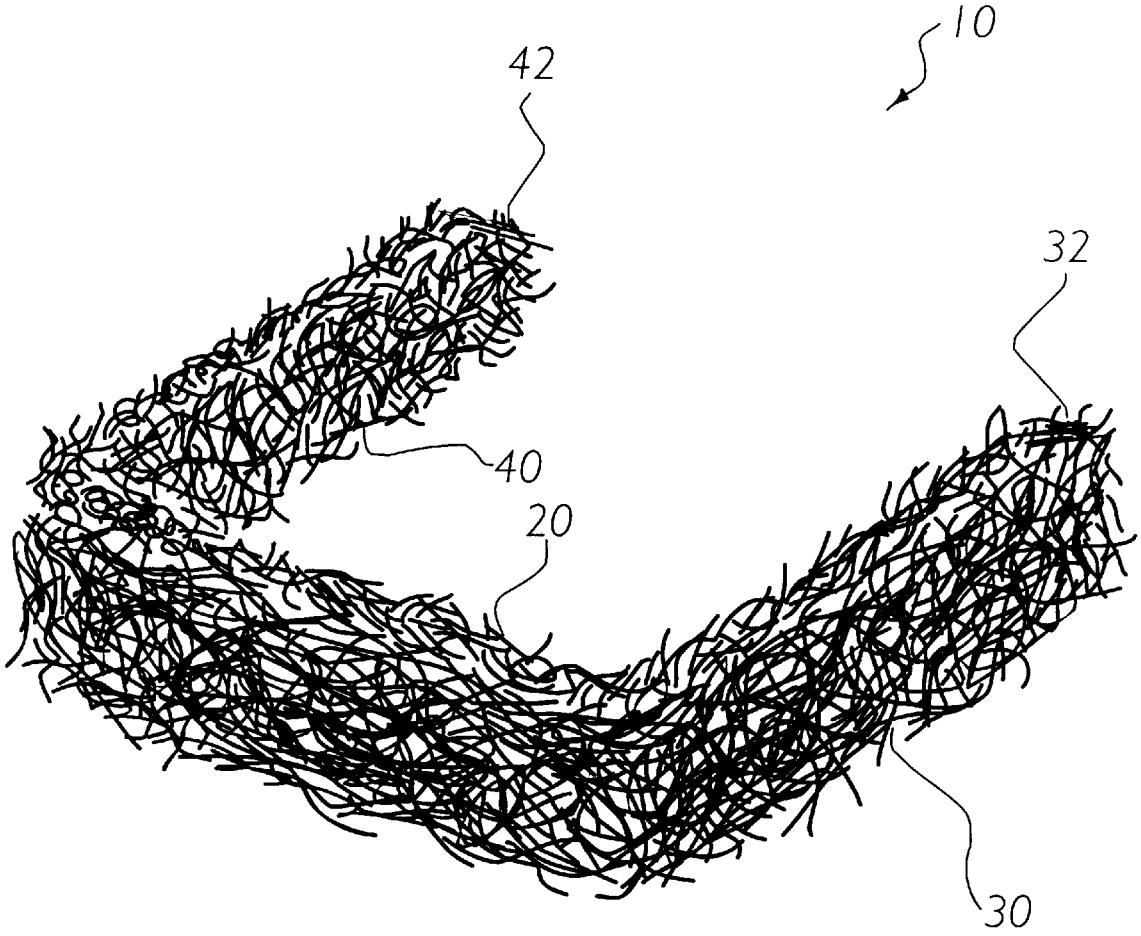
FIG. 1 is an upper perspective view of the present invention.

Turning now descriptively to the drawings, in which similar reference characters denote similar elements throughout the several view, FIGS. 1 through 5 illustrate a roof louver filter system 10, which comprises an air permeable material that is formed into a U-shaped structure for being positioned within a roof louver 12. The U-shaped structure includes a front portion 20, a first side portion 30 and a second side portion 40. The first side portion 30 includes a first slanted edge 32 and the second side portion 40 includes a second slanted edge 42 for conforming to the rear rim of the roof louver 12 when installed. The inventive device is preferably constructed of a polyester fiber material thereby preventing water and insects from entering into the roof louver 12. The inventive device prevents snow from directly blowing into the attic of the building through the roof louver 12 during inclimate weather conditions.

Figure 5:
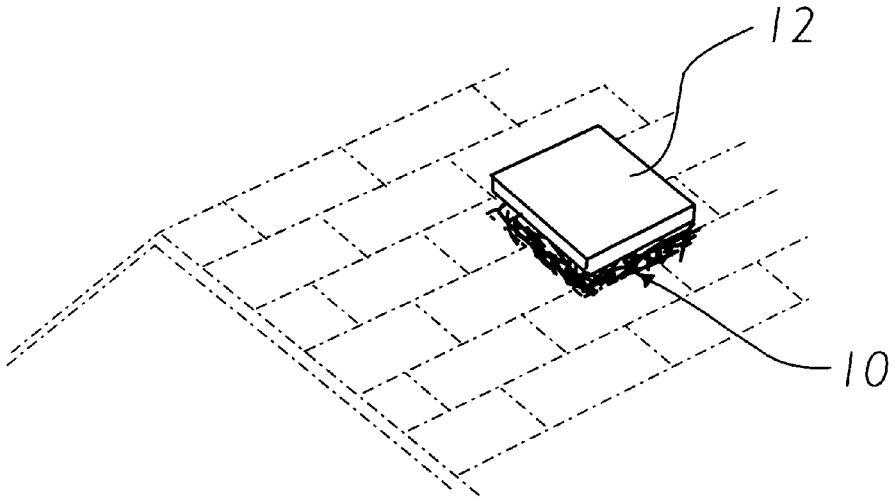
FIG. 5 is an upper perspective of the present invention installed between a roof louver and roof.

As best shown in FIG. 5 of the drawings, a conventional roof louver 12 is attached to the roof of the building structure. The roof louver 12 typically has a tubular structure that extends through the roof of the building structure and extends from the exterior surface of the roof a finite distance thereby allowing moist air within the attic to escape the attic. A shield member is attached a finite distance above the tubular structure thereby allowing the escape of warm moist air while preventing the entry of precipitation such as snow, sleet or rain into the tubular structure. The shield member has an outer rim that extends downwardly in an attempt to prevent high winds from blowing precipitation into the tubular structure.

Figure 3:
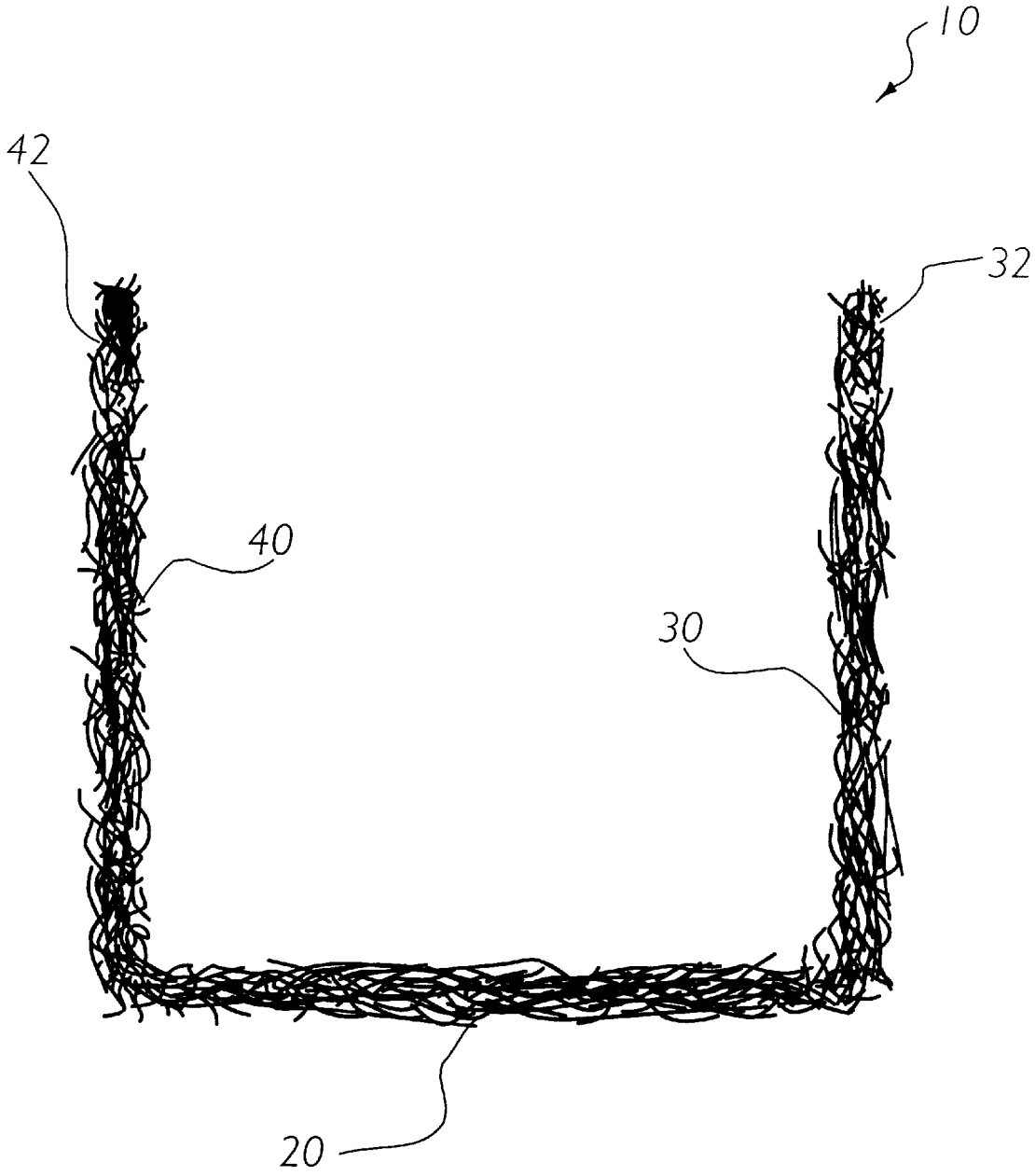
FIG. 3 is a top view of the present invention.

As best shown in FIG. 3 of the drawings, the inventive device preferably as a U-shape for protecting three sides of the roof louver 12. The inventive device is preferably constructed of a fiber material such as polyester. It can be appreciated that any well-known air permeable material may be utilized for constructing the present invention.

Figure 4:
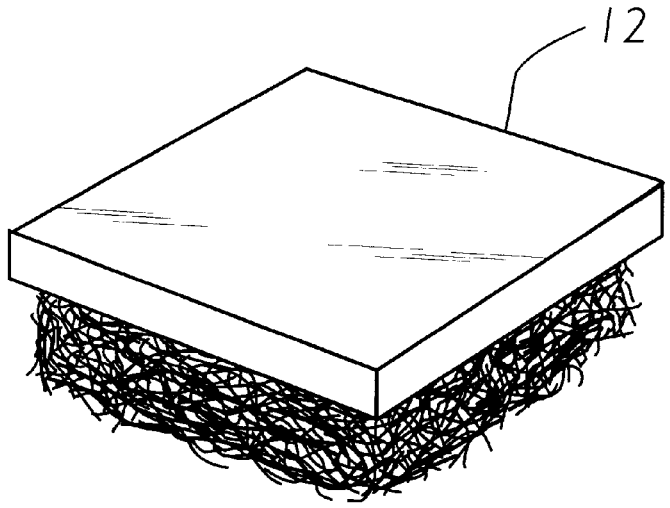
FIG. 4 is an upper perspective view of the present invention positioned within a roof louver.

As best shown in FIGS. 1 and 3 of the drawings, the inventive device includes a front portion 20. As shown in FIGS. 4 and 5 of the drawings, the front portion 20 is positionable within the front edge of the roof louver 12.

Figure 2:
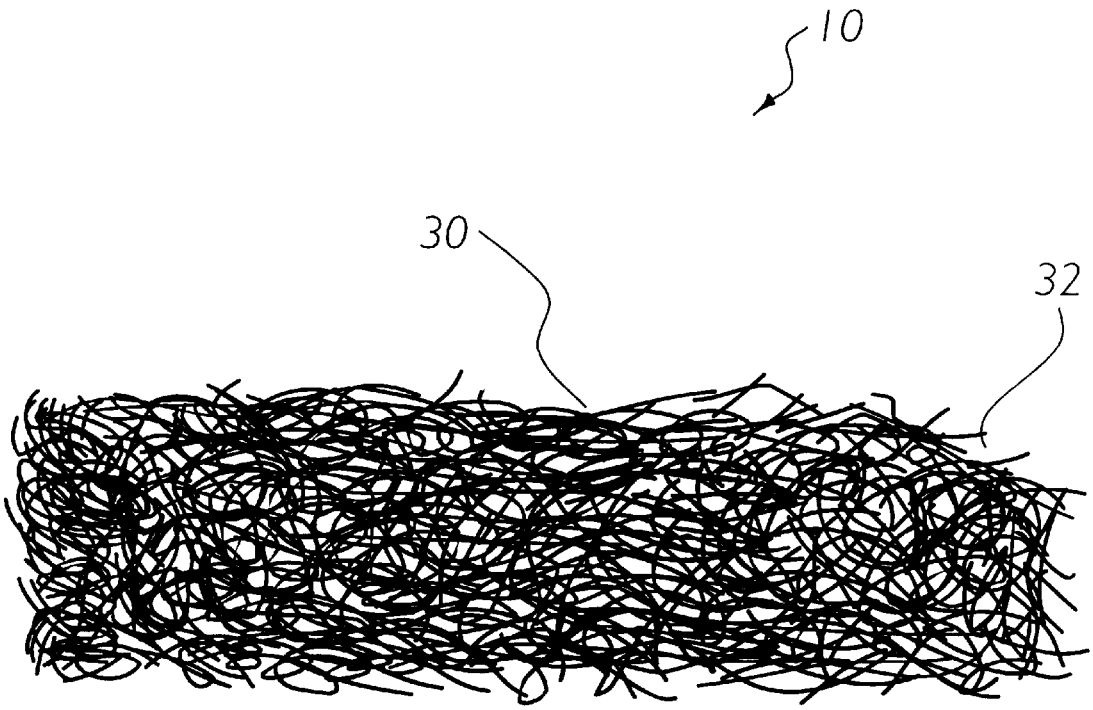
FIG. 2 is a side view of the present invention.

As shown in FIGS. 1 through 3 of the drawings, a first side portion 30 is attached orthogonally to the front portion 20. The first side portion 30 is positionable within a side of the roof louver 12 as shown in FIGS. 4 and 5 of the drawings. A first slanted edge 32 is within the distal end of the first side portion 30 for conforming to the slanted rear rim of the roof louver 12.

As shown in FIGS. 1 through 3 of the drawings, a second side portion 40 is attached orthogonally to the front portion 20 opposite of the first side portion 30. The second side portion 40 is positionable within a side of the roof louver 12 as shown in FIGS. 4 and 5 of the drawings. A second slanted edge 42 is within the distal end of the second side portion 40 for conforming to the slanted rear rim of the roof louver 12.

In use, the user accesses the roof of a building structure by conventional means such as a ladder. The user then locates the roof louver 12 and positions the first side portion 30 under a side of the roof louver 12. The user then positions the front portion 20 under the roof louver 12. The user then positions the second side portion 40 under the roof louver 12 opposite of the first side portion 30 as shown in FIGS. 4 and 5 of the drawings. The first slanted edge 32 and the second slanted edge 42 are juxtaposed to the rear rim of the roof louver 12. During inclimate weather such as winter storms, the wind gusts attempt to blow the snow into the roof louver 12 however the front portion 20, the first side portion 30 and the second side portion 40 prevent entry into the roof louver 12. During normal weather conditions, the warm moist air within the attic is released through the roof louver 12 then through the inventive device.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A roof louver filter system comprising:

a flat U-shaped structure comprised of a fiber material that is air permeable and positionable underneath a roof louver;

wherein said U-shaped structure comprises:

a front portion;

a first side portion attached orthogonally to an end of said front portion; and a second side portion attached orthogonally to an opposing end of said front portion;

wherein said first side portion includes a first slanted edge; and wherein said second side portion includes a second slanted edge.

2. A roof louver filter system, comprising:

a flat U-shaped structure comprised of a fiber material that is air permeable and positionable underneath a roof louver;

wherein said U-shaped structure comprises:

a front portion;

a first side portion attached orthogonally to an end of said front portion; and a second side portion attached orthogonally to an opposing end of said front portion.

3. The roof louver filter system of claim 2, wherein said first side portion includes a first slanted edge, and wherein said second side portion includes a second slanted edge.

4. A method of installing a roof louver filter system, comprising the steps of:

(a) providing a flat U-shaped structure comprised of a fiber material that is air permeable and positionable underneath a roof louver, wherein said U-shaped structure comprises a front portion, a first side portion attached orthogonally to an end of said front portion, and a second side portion attached orthogonally to an opposing end of said front portion;

(b) positioning said U-shaped structure adjacent a lower portion of said roof louver; and (c) manipulating said U-shaped structure underneath said roof louver until said front portion, said first side portion and said second side portion are completely underneath said roof louver.

* * * * *